United States Patent [19]

Bean

[11] Patent Number: 5,048,823

[45] Date of Patent: Sep. 17, 1991

[54] BALANCE BOARD

[76] Inventor: John A. Bean, 5455 Kiowa Dr., La Mesa, Calif. 92042

[21] Appl. No.: 572,693

[22] Filed: Aug. 27, 1990

[51] Int. Cl.[5] ..... A63B 22/16

[52] U.S. Cl. ..... 272/111; 272/146

[58] Field of Search ..... 272/93, 111, 146; 441/74; 114/346, 355, 357; 280/18, 18.1

[56] References Cited

U.S. PATENT DOCUMENTS

| | | | |
|---|---|---|---|
| 3,586,321 | 6/1969 | Gehrke | 272/146 |
| 3,612,520 | 8/1971 | Chang | 272/146 |
| 4,605,224 | 8/1986 | Torii | 272/146 |
| 4,801,140 | 1/1989 | Bergeron | 272/146 |

FOREIGN PATENT DOCUMENTS

| | | | |
|---|---|---|---|
| 0134047 | 3/1975 | European Pat. Off. | 272/146 |
| 2224216 | 10/1973 | Fed. Rep. of Germany | 272/111 |
| 3150189 | 7/1983 | Fed. Rep. of Germany | 272/111 |

*Primary Examiner*—Richard J. Apley
*Assistant Examiner*—L. Thomas
*Attorney, Agent, or Firm*—Frank D. Gilliam

[57] ABSTRACT

A balance board for exercise and amusement having a gyrating and rocking user platform. The balance board simulates the sensation of sports, such as, for example surfing, skiing, etc. The device is constructed of two principle components, namely, a base having a half semi-bulbous shape having a larger dimension at one end tapered toward the other end with a curvilinear smooth outer surface and a generally planar user support platform forming an upper surface of and attached to the base. The user support platform is angled slightly upwardly at one end. The base can be constructed of a smooth plastic or the like and the user platform of plastic, wood or the like with a non-slip user outer surface covering.

11 Claims, 2 Drawing Sheets

BALANCE BOARD

BACKGROUND OF THE INVENTION

The invention is directed to exercise devices and particularly to an exercise device for simulating the physical action of various sports such as, but not limited to skiing, surfing and the like.

U.S. Pat. No. 3,512,774 teaches a rotatable exercise platform formed of two metal plates of equal diameter sufficient to support the feet of a human user. A large diameter ring of balls are positioned between the disks. One disk remains in position while the opposed disk is free to rotate relative thereto.

U.S. Pat. No. 3,612,529 teaches a exercise device for skiers in the form of a hollow bowl with a platform on which the user stands. A fixed in positioned weight centrally positioned in the bowl bottom act to lower the center of gravity of the device and a vertically positionable weight to vary the center of gravity.

U.S. Pat. No 4,206,558 teaches an exercise shoe for ware on a human foot including a foot engaging platform, a foot attachment strap and a hyperbolic bottom support surface.

U.S. Pat. No. 4,436,513 teaches a free-sail system sailboard simulator is taught. The user platform rotates relative to its base. The device provides the feel of a sail board under the feet of a beginner.

U.S. Pat. No. 4,505,477 teaches an elongated balancing board with a pair of side-by-side tracks on the bottom surface thereof. A pair of spaced apart wheels on a common shaft and roll along the side-by-side tracks. The wheels are biased to the center of the board by resilient members.

U.S. Pat. No. 4,509,743 teaches a balancing training apparatus for athletes such as down hill skiers comprising a base adapted to rest on a floor surface or the like, a foot plate mounted in a spaced relationship to the base. The base is attached to the foot plate by a plurality of spaced apart springs in a circular arrangement. A driving mechanism imparts a continuous irregular tilting movement to the foot plate.

U.S. Pat. No. 4,601,469 teaches a circular balance board supported by a roller which is free to translate in tracks a portion of the length of the under side of the balance board. The roller translates relative to the distribution of the user's weight on the upper surface.

Generally stated the prior art balance boards noted above merely provide means of improving ones balancing skills on a particular device and do not simulate the balance conditions actually encountered in the sport of skiing, surfing or the like. There has not been a suitable device to actually simulated the balance required in sports such as sholom skiing, ocean surfing and like sports until the emergence of the present invention.

SUMMARY OF THE INVENTION

The balancing device of the present invention comprises a elongated bowl or half semi-bulbous shaped support surface and a rectilinear top or user support surface. In plan view the user support surface has a curvilinear front or nose surface substantially semi-circular shape and a rear or back end surface rectilinear in shape and smaller in width than the diameter of the front surface. The side surfaces between the ends makes a smooth transition therebetween. In plan the user support surface resembles generally a body surfing board well known in the body surfing art. The distal end or tip of the rear end of the support surface is formed slightly upwardly from the general overall planar support surface at an obtuse angle. The balance device of the invention is formed of three joined together members, namely, the elongated bowl, the upper support surface and a molded rail. These members are joined by fastener means shown for convenience as screws. Other fastening means such as adhesives or the like could be used equally as well at practice the invention. The elongated bowl has a plurality of concave inwardly formed channels for receiving and concealing the screws which thread into the bottom surface of the support member adjacent to the outer edge periphery thereof. The molded rail extends beyond the outer periphery of the elongated bowl and platform and is formed as a curvilinear rail with a thick molded cross-section for gripping by the fingers of the user.

An object of this invention is to provide an exercise device that simulates sports such as skiing, surfing or the like.

Another object of this invention is to provide a balance board simulator for simulating the physical actions encountered in various active sports.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENT OF THE INVENTION

Figure 1:
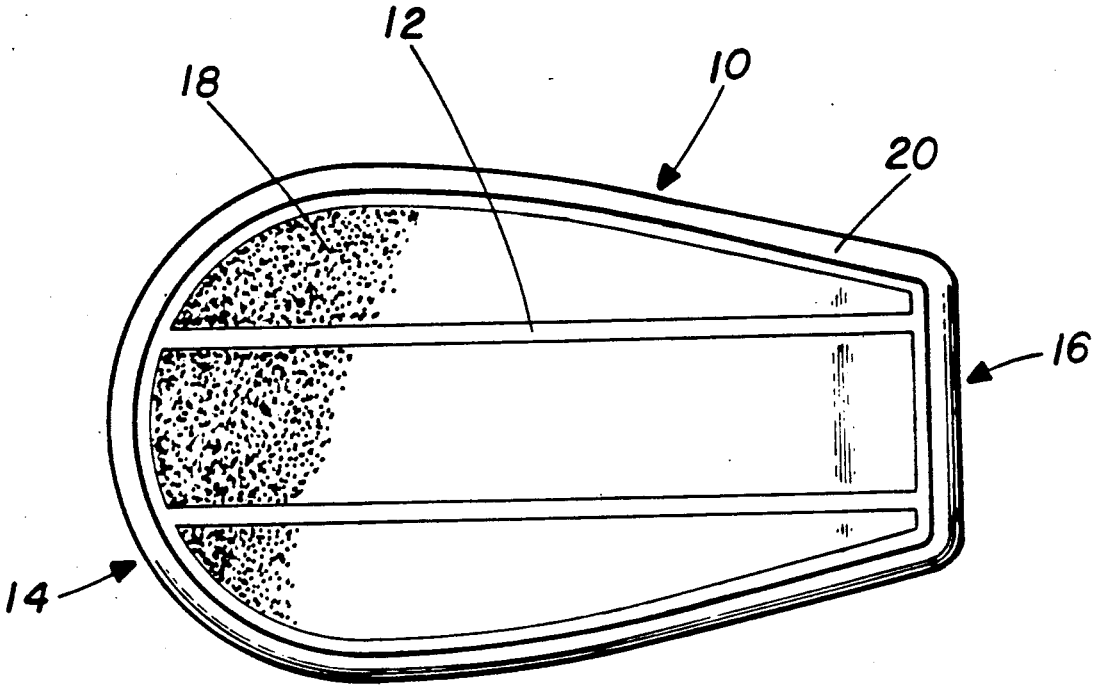
FIG. 1 is a plan view of the balance simulator of the invention.

Referring now to the various drawing Figures which depict the preferred embodiment of the invention. FIG. 1 is a plan view showing of the balance simulator 10 of the invention. The upper user surface 12 is shaped generally in the form of a body surfing board with a curvilinear nose or front surface 14 and a squared off or blunt rear or tail surface 16. The tail surface has a smaller width than the diameter of the nose surface 14. The sides between the nose and tail surfaces have a smooth slightly curvilinear taper therebetween. At least a portion of the upper surface includes a roughened surface 18. Shown in longitudinal strips or sections. The roughened surface may take many different configurations or designs to accomplish the purpose of providing a non-slip surface to the user standing on the upper surface. The non-slip surface may comprise discrete strips of adhesively attached non-slip material. The rail 20 is rounded as can be clearly seen in drawing FIG. 3 with a gripping area 21 on the under surface thereof adjacent to the body portion 22.

Figure 2:
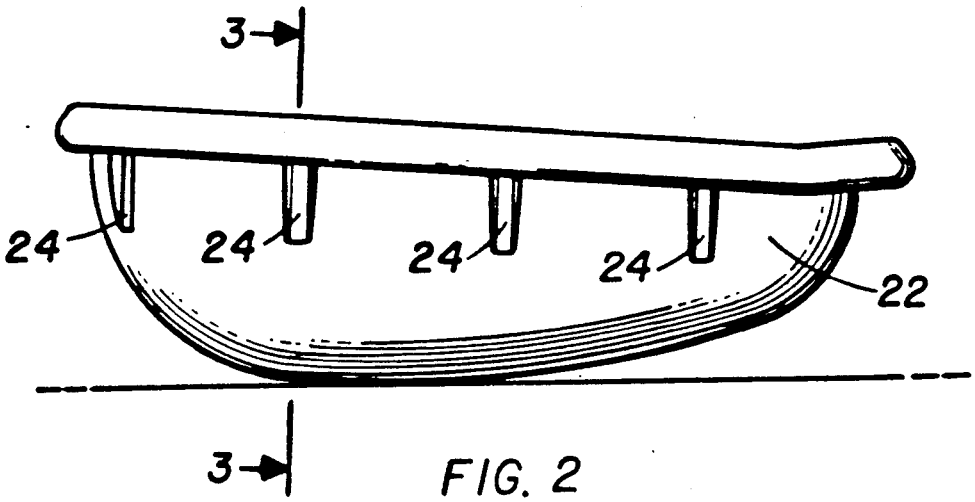
FIG. 2 is a side elevation showing of the balance simulator of the invention.

Referring now to drawing FIG. 2 which is a side elevation of the balance simulator 10 of the invention. As seen in drawing FIG. 2, the body portion 22 of the balance board simulator of the invention is in the form of a half semi-bulbus hollow structure or shell not unlike the shape of the body of a lute musical instrument. The body has a large diameter curvilinear nose or forward end 14 and the upper surface of the balance simulator tapers to a smaller diameter rectilinear tail or rear section 16. The body portion has a smooth outer surface and is formed of plastic, inflatable vinyl, closed foam or the like as is the rail portion 20. Fastening means such as, screws or the like, secure the user upper surface 12, the rail 20 to the body portion 22 as can more clearly be seen in drawing FIG. 3 and hereinafter explained in more detail. Spacedly positioned around the surface of the body portion 22 are plurality of vertically directed concave indentations 24 for placing the fastening means 26 away from the rail and for concealing the fastening means.

Figure 3:
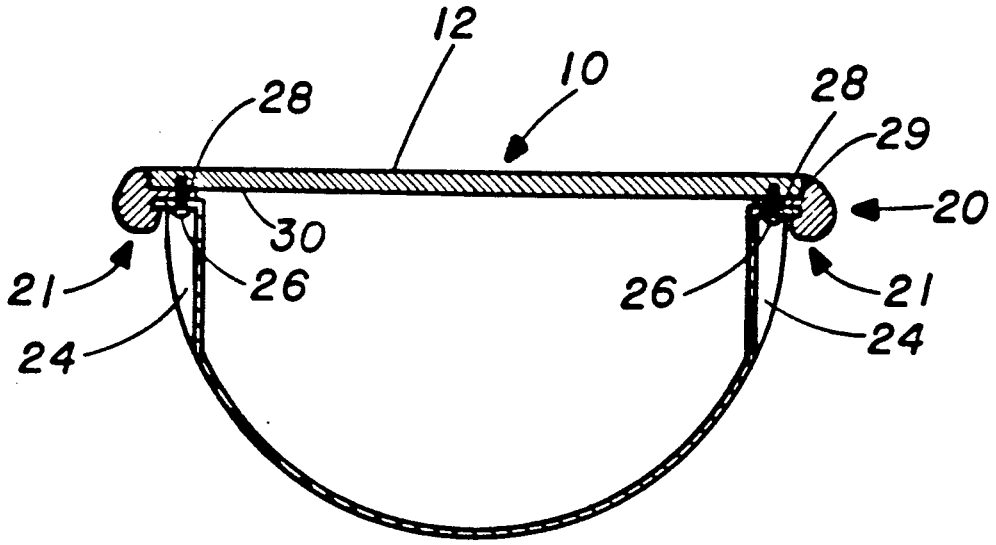
FIG. 3 is a showing taken along line 3—3 of FIG. 2.

Referring now to drawing FIG. 3 is detail, drawing FIG. 3 depicts a transverse cutaway showing of the details of the joinder of the user upper surface 12, the rail 20 and the body portion 22 of the balance simulator of the invention. As shown in the Figure, the upper user surface, rail and the body portion are secured together by means of screws threaded through the upper lip 28 of the body portion, through an extension 29 of the rail 20 and into the under side 30 of the upper user surface 12. A washer, not shown, may be positioned between the screw head and the body portion to make the attachment of the members more secure.

Preferably the largest vertical dimension of the body portion, near the nose, is approximately in the range of 6 to 10 inches with around 8.5 inches ideal and the smallest vertical elevation near the tail being about two thirds the largest vertical elevation. The overall length of the balance simulator of the invention is in the range of 26 to 30 inches with the ideal length approximately 28 inches.

In use a person climbs upon the upper user surface 12 of the device and either maintains hands free from the device or grasps the gripping area 21 in the under side of the user surface while shifting body weight and attempting to continue to maintain balance upon the board.

Figure 4:
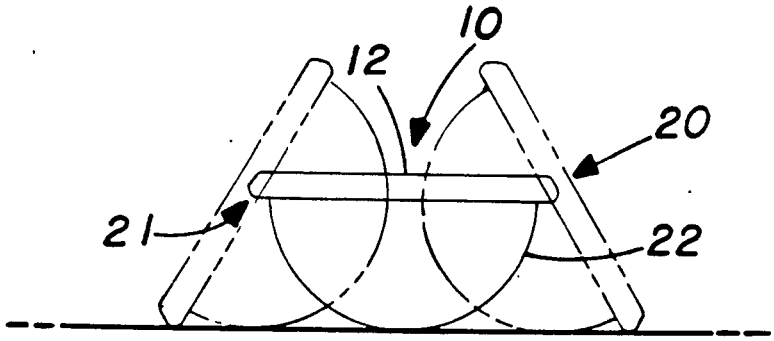
FIG. 4 depicts in phantom the maximum rotational limits of the board along its longitudinal axis.

Drawing FIG. 4 shows the maximum limits of the rolling or tilting of the device of the invention in a transverse direction.

Figure 5:
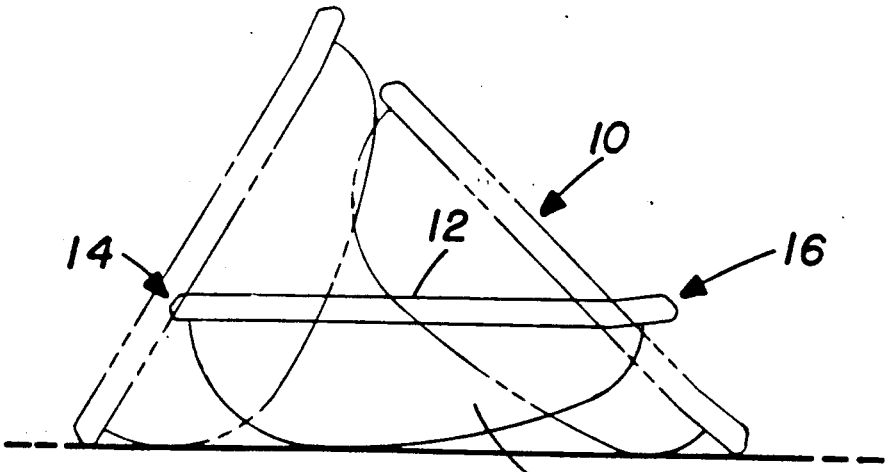
FIG. 5 depicts in phantom the maximum rotational limits of the board along its transverse axes.

Drawing FIG. 5 shows the maximum limits of operator rolling or tilting of the device of the invention in a longitudinal direction.

While a specific embodiment the balance board simulator has been shown and fully explained above for the purpose of illustration it should be understood that many alterations, modifications and substitutions may be made to the instant invention disclosure without departing from the spirit and scope of the invention as defined by the appended claims.

What is claimed is:

1. A balance board simulator comprising:

an upper user surface member having a curvilinear front nose surface and a rectilinear back tail surface, said tail surface having a width smaller than the diameter of said nose surface;

a lower semi-bulbous base portion having a front nose portion and a rear tail portion, said lower base portion having a greater vertical elevation at said front nose portion than said tail portion thereof, said base portion having curvilinear indentations spacedly positioned along the upper periphery thereof;

a curvilinear rail member having an extended lip around its inner periphery; and fastening means for securing together into a unitary structure said base portion, said lip of said rail member and said upper surface member.

2. The invention as defined in claim 1 wherein said upper user surface further comprises means for roughening the upper exposed surface thereof.

3. The invention as defined in claim 2 wherein said means for roughening said exposed surface comprises providing discrete areas of non-slip strip material adhesively bonded to said upper exposed surface thereof.

4. The invention as defined in claim 1 wherein the tail surface of said upper user surface has an upwardly extending tip.

5. The invention as defined in claim 1 wherein said upper surface member is constructed of plastic.

6. The invention as defined in claim 1 wherein said upper surface member is constructed of wood.

7. The invention as defined in claim 1 wherein said fastening means is screws and said screws pass through the base portion within said indentations, through said lip and into said upper surface member.

8. The invention as defined in claim 1 wherein said base portion is hollow.

9. The invention as defined in claim 1 wherein said base portion is constructed of plastic.

10. The invention as defined in claim 1 wherein said rail member is molded from plastic.

11. The invention as defined in claim 1 wherein said rail member additionally comprises a gripping surface on the base portion adjacent under surface.

* * * * *